US006266503B1

(12) United States Patent
Murayama et al.

(10) Patent No.: US 6,266,503 B1
(45) Date of Patent: Jul. 24, 2001

(54) METHOD FOR ATTACHING ELECTROSTATIC PHOTOSENSITIVE DRUM METHOD FOR REPLACING ELECTROPHOTOGRAPHIC PHOTOSENSITIVE DRUM AND PROCESS CARTRIDGE

(75) Inventors: Kazunari Murayama, Shizuoka-ken; Hisayoshi Kojima, Mishima; Tomonori Mori, Numazu, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/385,057

(22) Filed: Aug. 30, 1999

(30) Foreign Application Priority Data

Aug. 31, 1998 (JP) ..... 10-245222

(51) Int. Cl.[7] ..... G03G 15/00

(52) U.S. Cl. ..... 399/117

(58) Field of Search ..... 399/109, 111, 399/116, 117, 159, 167, 26

(56) References Cited

U.S. PATENT DOCUMENTS 5,235,383 8/1993 Tada et al. .
5,249,026 9/1993 Kojima .

(List continued on next page.)

FOREIGN PATENT DOCUMENTS 0 467 418 A1 1/1992 (EP) .
56-117272 9/1981 (JP) .

(List continued on next page.)

OTHER PUBLICATIONS

Patent Abstracts of Japan, vol. 1996, No. 5, 31 May 31, 1996 (JP–08–006470, Jan. 12, 1996).
Patent Abstracts of Japan, vol. 18, No. 426 Aug. 9, 1994 (JP–06–130874, May 13, 1994).
Patent Abstracts of Japan, vol. 18, No. 21, Jan. 13, 1994 (JP–05–257342, Oct.8, 1993).

*Primary Examiner*—Sandra Brase
(74) *Attorney, Agent, or Firm*—Fitzpatrick, Cella, Harper & Scinto

(57) ABSTRACT

An electrophotographic photosensitive drum mounting method for mounting an electrophotographic photosensitive drum to a frame of a process cartridge detachably mountable to a main assembly of an electrophotographic image forming apparatus, the method including the steps of (a) a first inserting step of inserting a first drum shaft provided at one end of the electrophotographic photosensitive drum into a first frame hole provided in a first projected portion at one end portion which is projected in a direction crossing with a longitudinal direction of a frame of the process cartridge at one longitudinal end of the frame of; (b) facing step of facing, while the first drum shaft is inserted into the first frame hole, the other end of the electrophotographic photosensitive drum to a second projected portion projected from the frame in a direction crossing with the longitudinal direction of the frame at the other longitudinal end of the frame, by moving the other end of the electrophotographic photosensitive drum; (c) a second inserting step of inserting a second drum shaft provided on a second cover at the other end into a second frame hole provided in a projected portion at the other end of the frame and then into a drum hole formed at the other end of the electrophotographic photosensitive drum, from an outside of the second frame hole; (d) a bearing member engaging step of fitting a bearing hole of a bearing member around the first drum shaft, and engaging the bearing member with the first frame hole; (e) a first cover coupling process of fitting first hole formed in a first cover provided at one end around the first drum shaft, and then connecting the first cover to the frame; and (f) a second cover coupling process of connecting the second cover to the frame.

16 Claims, 13 Drawing Sheets

U.S. PATENT DOCUMENTS

| | | | | |
|---|---|---|---|---|
| 5,402,207 | * | 3/1995 | Michlin | 399/117 |
| 5,442,421 | | 8/1995 | Kojima . | |
| 5,446,525 | * | 8/1995 | Kobayashi | 399/111 |
| 5,471,284 | | 11/1995 | Fujii et al. . | |
| 5,497,220 | | 3/1996 | Inomata et al. . | |
| 5,521,693 | | 5/1996 | Kojima et al. . | |
| 5,640,650 | * | 6/1997 | Watanabe et al. | 399/117 |
| 5,689,774 | * | 11/1997 | Shishido et al. | 399/111 |
| 5,749,028 | * | 5/1998 | Damji et al. | 399/117 |
| 5,930,562 | * | 7/1999 | Noda et al. | 399/167 X |
| 5,940,657 | | 8/1999 | Yokomori et al. | 399/119 |
| 5,950,049 | | 9/1999 | Yokomori et al. | 399/119 |
| 5,963,759 | | 10/1999 | Kojima et al. | 399/111 |
| 6,044,235 | * | 3/2000 | Hashimoto | 399/111 X |

FOREIGN PATENT DOCUMENTS

| | | |
|---|---|---|
| 63-106777 | 5/1988 | (JP) . |
| 63-165890 | 7/1988 | (JP) . |
| 2-35163 | 3/1990 | (JP) . |
| 2-109357 | 8/1990 | (JP) . |
| 4-485 | 1/1992 | (JP) . |
| 5-134483 | 5/1993 | (JP) . |
| 7-334036 | 12/1995 | (JP) . |
| 10-153940 | 6/1998 | (JP) . |

* cited by examiner

METHOD FOR ATTACHING ELECTROSTATIC PHOTOSENSITIVE DRUM METHOD FOR REPLACING ELECTROPHOTOGRAPHIC PHOTOSENSITIVE DRUM AND PROCESS CARTRIDGE

FIELD OF THE INVENTION AND RELATED ART

The present invention relates to a method for attaching an electrophotographic photosensitive drum to the frame of a process cartridge removably installable in the main assembly of an electrophotographic image forming apparatus, a method for replacing the aforementioned electrophotographic photosensitive drum, and a process cartridge.

The electrophotographic image forming apparatus referred to in this specification is such an apparatus that forms an image on a piece of a recording medium with the use of an electrophotographic image formation process. It comprises, for example, an electrophotographic copying machine, an electrophotographic printer (LED printer, laser beam printer, and the like), an electrophotographic facsimile machine, an electrophotographic word processor, and the like.

The process cartridge referred to in this specification is such a cartridge that integrally comprises at least one processing means among a charging means, a developing means, and a cleaning means, and an electrophotographic photosensitive member, and can be removably installed in the main assembly of an electrophotographic image forming apparatus.

A process cartridge system, according to which an electrophotographic photosensitive drum, and at least one processing means that works on the electrophotographic drum, are integrated into the form of a cartridge removably installable in the main assembly of an image forming apparatus, has been employed by an image forming apparatus, which employs an electrophotographic image formation process. A process cartridge system makes it possible for users to maintain the apparatus without relying upon service personnel, and therefore, it drastically improves the operational efficiency of the apparatus. Thus, a process cartridge has been employed in a wide range of image forming apparatuses.

A process cartridge is a cartridge that comprises an electrophotographic photosensitive drum and at least one processing means. As for the processing means, there are a charging means for charging an electrophotographic photosensitive drum, a developing means for developing an electrostatic latent image formed on an electrophotographic photosensitive drum, with the use of toner, a cleaning means for removing the toner that remains on the peripheral surface of the electrophotographic photosensitive drum, and the like.

In the past, in order to attach a photosensitive drum to the frame of the aforementioned process cartridge, each of the longitudinal ends of the photosensitive drum was provided with a drum shaft, and this structural arrangement has been well known. According to this structural arrangement, the process cartridge frame is provided with two holes: one for supporting the drum shaft at one of the longitudinal ends of the photosensitive drum, and the other for supporting the drum shaft at the other longitudinal end. Further, a portion of each of the frame portions provided with the hole for supporting the drum shaft was removed for fitting the drum shaft into the hole.

There has been known another structure, according to which only one of the longitudinal ends of a photosensitive drum is provided with the drum shaft; the other end is not provided with the drum shaft. More specifically, in order to support the drum, the drum shaft provided at one end of the photosensitive drum is inserted into the hole provided in one of the drum supporting portions of the cartridge frame, and another drum shaft is inserted into the other end of the photosensitive drum, from outside the frame, through the hole cut in the other drum supporting portion of the frame, after the other end of the photosensitive drum is moved to be aligned with the hole cut in the other drum supporting portion.

SUMMARY OF THE INVENTION

The present invention has been derived from the improvement of the aforementioned conventional technology.

Thus, the primary object of the present invention is to provide a method for attaching a photosensitive drum, a method for replacing a photosensitive drum, and a process cartridge, which improve the efficiency with which an electrophotographic photosensitive drum is attached to the frame of a process cartridge, and the efficiency with which an electrophotographic photosensitive drum is replaced.

Another object of the present invention is to provide a method for attaching a photosensitive drum, a method for replacing a photosensitive drum, and a process cartridge, which make it possible to reliably maintain the rotational accuracy of an electrophotographic photosensitive drum.

Another object of the present invention is to provide a method for attaching a photosensitive drum, a method for replacing a photosensitive drum, and a process cartridge, which are capable of minimizing the reduction in the process-cartridge frame strength.

Another object of the present invention is to provide a method for attaching a photosensitive drum, a method for replacing a photosensitive drum, and a process cartridge, which make it possible to provide a sufficient gap between the surface of the frame hole and the external peripheral surface of the drum shaft prior to the fitting of a bearing into the bearing hole of the frame. This aspect of the present invention improves the efficiency with which one of the longitudinal ends of a photosensitive drum is moved to a point, at which this longitudinal end of the drum becomes aligned with the projecting portion of the frame, after the drum shaft with which the other longitudinal end of the photosensitive drum is provided, is inserted into the corresponding shaft hole in the frame.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

Hereinafter, the embodiments of the present invention will be described in detail with reference to the appended drawings.

In the following descriptions of the embodiments of the present invention, the width direction of a process cartridge B means refers to the direction that coincides with the conveyance direction of recording medium, whereas, the longitudinal direction of the process cartridge B means refers to the direction in which the process cartridge B is inserted into the main assembly 14 of an image forming apparatus, and which crosses (is approximately perpendicular to) the recording-medium conveyance direction. The terms "right and left" of the process cartridge B means the right and the left of the process cartridge B as the process cartridge B is seen from above, and from behind the recording medium in terms of the recording-medium conveyance direction.

Embodiment 1

Description of General Structure of Electro-photographic Image Forming Apparatus First, the general structure of an electrophotographic image forming apparatus will be described with reference to FIG. 1.

Figure 1:
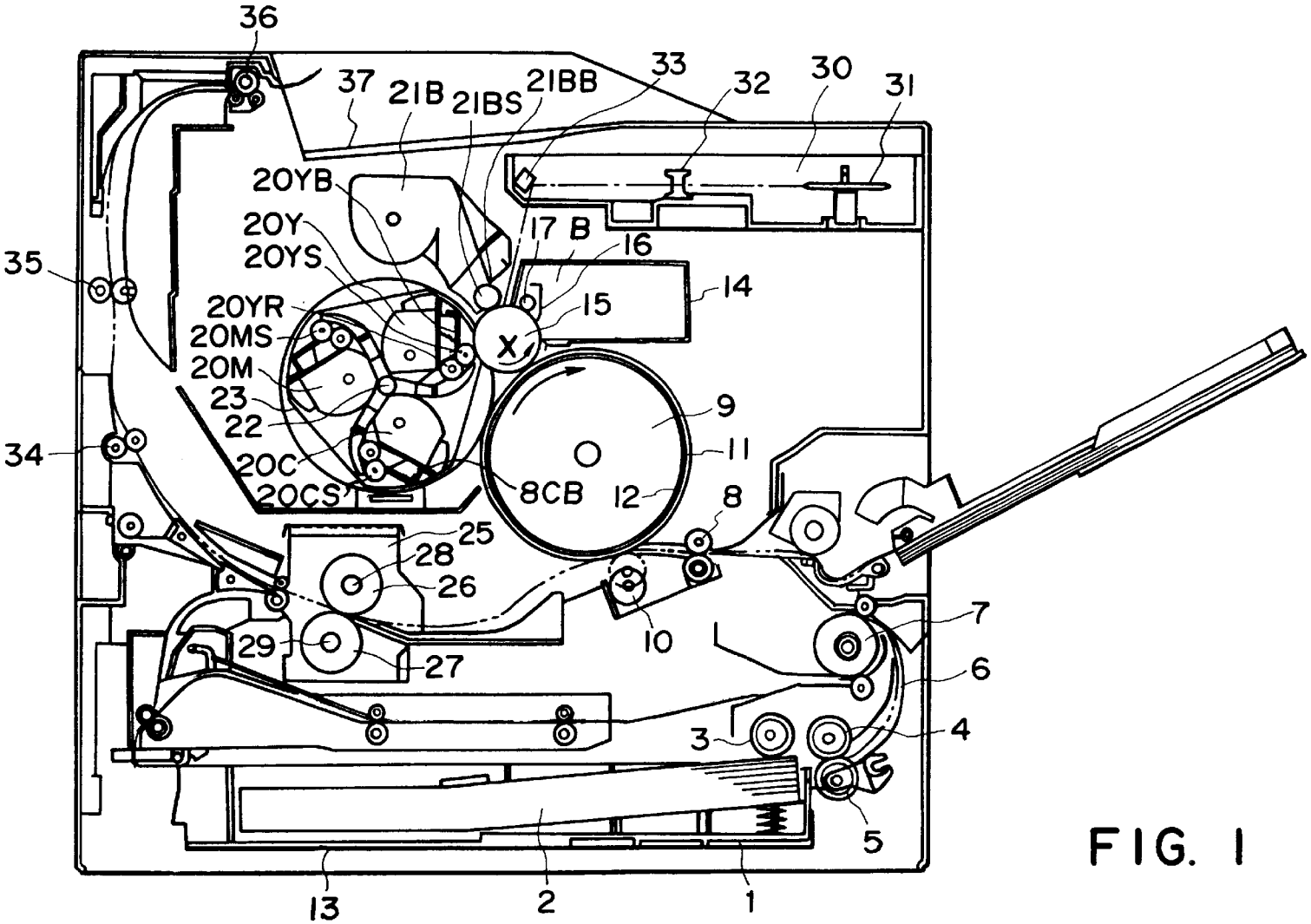
FIG. 1 is a vertical sectional view of a multi-color laser printer in which a process cartridge in accordance with the present invention is installable.

FIG. 1 is a vertical sectional view of a full-color laser beam printer, a form of a full-color image forming apparatus, which depicts the general structure of the printer.

As shown in FIG. 1, reference numeral 15 designates an electrophotographic photosensitive member in the form of a drum (hereinafter, photo-sensitive drum), which rotates at a predetermined peripheral velocity. Reference character 21B designates a black color developing device, which is fixedly disposed. Each of reference characters 20Y, 20M, and 20C designates a chromatic developing device, the position of which can be changed. Reference numeral character 9 designates an intermediary transfer member, onto which color toner images are transferred in layers from the photosensitive drum 15, and from which the color toner images having been transferred in layers from the photosensitive drum 15 are transferred onto a piece of recording medium 2. After receiving the color toner images, the recording medium 2 is conveyed to a fixing station 25, in which the color toner images are fixed to the recording medium 2. Thereafter, the recording medium 2 is discharged into a delivery tray 37 located at the top of the apparatus, by discharge rollers 34, 35, and 36. The chromatic developing devices 20Y, 20M, and 20C, and the black color developing device 20B, can be individually mounted into, or removed from, the main assembly 13 of the image forming apparatus.

Next, the structure of each portion of the aforementioned image forming apparatus will be described in detail.

Process Cartridge

The housing portion of the process cartridge B integrally comprises the cleaning-means housing 14, which houses the electrophotographic photosensitive drum 15 as well as the cleaning means. The cleaning means housing 14 also doubles as the holder for the photosensitive drum 15. The process cartridge B is removably installable in the apparatus main assembly 13; it is easily replaceable by the operators themselves according to the service life of the photosensitive drum 15. The photosensitive drum 15 in this embodiment consists of an aluminum cylinder, which is approximately 60 mm in diameter, and approximately 365 mm in length, and a layer of organic photoconductor coated on the peripheral surface of the aluminum cylinder. It is rotationally supported by the cleaning-means housing 14. Along the peripheral surface of the photosensitive drum 15, a cleaning blade 16 and a primary charging means 17 are disposed. The photosensitive drum 15 is rotated in the counterclockwise direction illustrated in FIG. 1 by an arrow marked x, in coordination with an image forming operation.

Charging Means

The charging means in this embodiment employs a contact-type charging method. In operation, a charge roller 17 (electrically conductive roller) is placed in contact with the photosensitive drum 15, and as electrical voltage is applied to the charge roller 17, the peripheral surface of the photosensitive drum 15 is uniformly charged.

The process of exposing the aforementioned photosensitive drum 15, according to image formation data, is carried out by a scanner 30. More specifically, as an image formation signal is given to a laser diode (unillustrated), the laser diode projects a beam of light modulated with the image formation signal, to a polygon mirror 31, which is being rotated at a high speed by a scanner motor. The beam of modulated light is deflected by the polygon mirror 31, is passed through a focusing lens 32, and is deflected by a mirror 33, so that the peripheral surface of the photosensitive drum 15, which is being rotated at a predetermined peripheral velocity, is selectively exposed. As a result, an electrostatic latent image, which reflects the image formation data, is formed on the peripheral surface of the photosensitive drum 15.

Developing Means

The developing means comprises three chromatic developing devices 20Y, 20M, and 20C, which develop the aforementioned electrostatic latent image into a visual image, that is, a yellow image, a magenta image, and a cyan image, correspondingly, and a single black color developing device 21B, which develops the latent image into a black image.

The black color developing device 21B is a fixedly disposed device; it is fixedly disposed at a position at which the peripheral surface of the photosensitive drum 15 and the development roller 21Bs squarely face each other with the presence of a microscopic gap (approximately 300 m) between the two surfaces, so that a toner image is composed of black toner, on the peripheral surface of the photosensitive drum 15.

The black color developing device 21B comprises a toner conveying mechanism, which conveys the toner within the container toward the development roller 21BS. The toner delivered to the development roller 21BS is coated on the peripheral surface of the development sleeve BS, which is being rotated in the illustrated clockwise direction, while being triboelectrically charged, by a development blade 21BB, which is kept under pressure and which works in the direction to press the development sleeve 21BS upon the peripheral surface of the development roller 21BS. As a development bias is applied to the development roller 21BS, an electrostatic latent image, which was formed on the photosensitive drum 15, is developed into a visible image by the toner.

The three chromatic developing devices 20Y (contains yellow color toner), 20M (contains magenta color toner), and 20C (contains cyan color toner) are removably mounted in a development rotary 23, which is rotatable about a rotary shaft 22. In an image forming operation, they are rotationally moved about the rotary shaft 22 while being held in the development rotary 23. Also during the image forming operation, the rotary 23 is intermittently moved to position the development roller 20YS, 20MS, and 20CS at a location at which their peripheral surfaces squarely face the peripheral surface of the photosensitive drum 15 with the presence of microscopic gap (approximately 300 m) between the two surfaces. The developing devices 20Y, 20M, and 20C develop the electrostatic latent image, having been formed on the peripheral surface of the photosensitive drum 15, with the use of the yellow color toner, magenta color toner, and cyan color toner, correspondingly. In a full-color image forming operation, the development rotary 23 is rotated once for each rotation of the intermediary transfer member 9, so that the development process is carried out by the yellow color developing device 20Y, the magenta color developing device 20M, and the cyan color developing device 20C, in this order. The development process by the black color developing device 21B is carried out last.

FIG. 1 depicts the state the image forming apparatus in which the yellow developing device 20Y, containing the yellow color toner, is at a position at which the peripheral surface of the device 20Y squarely faces the peripheral surface of the photosensitive drum 15 in the process cartridge B.

The development rollers 20YS, 20MS, and 20CS become connected to a high voltage development power source and a driving force transmission mechanism, with which the printer main assembly 13 is provided, as they are moved to the development position.

Intermediary Transfer Member

In each full-color image forming operation, the intermediary transfer member 9 receives, in layers, four toner images of different color (toner images composed of Y, M, C, and B color toners), after the images are developed on the photosensitive drum 15 by the developing devices 20Y, 20M, 20C, and 21B. Thus, the intermediary transfer member 9 must be rotationally driven in the illustrated clockwise direction, in synchronism with the peripheral velocity of the photosensitive drum 15. After receiving in layers the four toner images, the intermediary transfer member 9 conveys the recording medium 2 forward by pinching the recording medium 2 between itself and a transfer roller 10 to which voltage is being applied, so that as the recording medium 2 is conveyed forward, the four toner image of different color on the intermediary transfer member 9 are transferred onto the recording medium 2.

The intermediary transfer member 9 in this embodiment consists of an aluminum cylinder 12 with a diameter of 180 mm, and an elastic layer 11, which covers the peripheral surface of the aluminum cylinder 12. The elastic layer 11 is formed of sponge, rubber, or the like. The intermediary transfer member 9 rotates by receiving a driving force from the apparatus main assembly through the gear (unillustrated) with which the intermediary transfer member 9 is provided.

Cleaning Means

Figure 2:
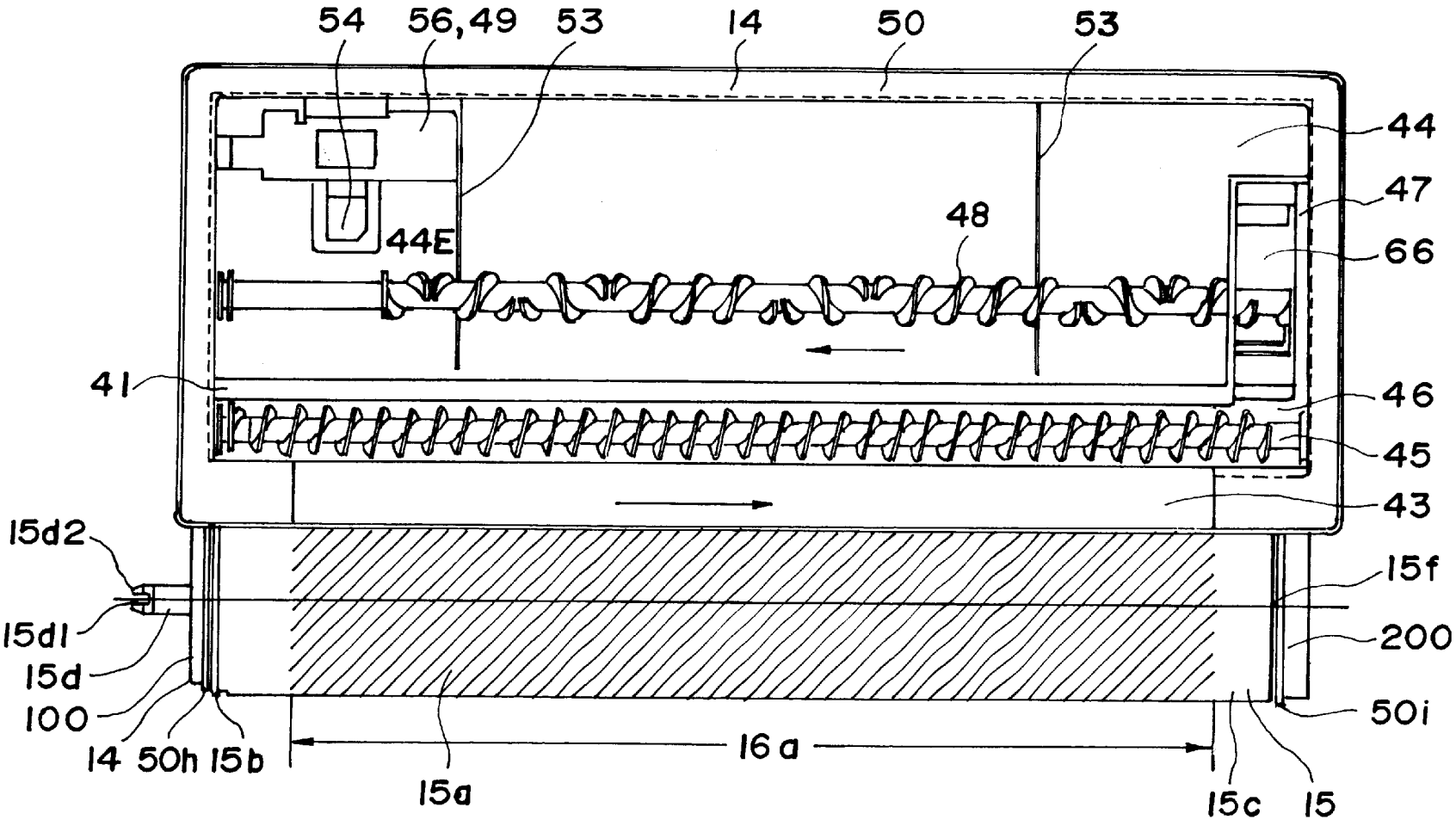
FIG. 2 is a plan view (partially cut open) of a process cartridge in accordance with the present invention.

The cleaning means is a means for recovering the toner which remains on the photosensitive drum 15 after the toner image on the photosensitive drum 15 is transferred onto the intermediary transfer member 9. After the removal of the toner from the photosensitive drum 15, the removed toner is collected in the cleaning-means housing 14. Referring to FIG. 2, along the peripheral surface of the photosensitive drum 15, a cleaning roller 60 is disposed on the upstream side of the cleaning blade 16 with reference to the rotational direction of the photosensitive drum 15. This roller 60 is rotated in the direction opposite to the rotational direction of the photosensitive drum 15 in the manner of rubbing the peripheral surface of the photosensitive drum 15. The toner storage capacity of the cleaning means housing 14 is large enough to prevent the cleaning-means housing 14 from being filled up by the removed toner before the service life of the photosensitive drum 15 expires. Thus, the cleaning means housing 14 is replaced along with the photosensitive drum 15 as the photosensitive drum 15 is replaced after its service life expires.

Conveying Means

The conveying means is a means for conveying the recording medium 2 to the image formation station. It essentially consists of a cassette 1, conveyer rollers 3 and 4, a retard roller 5, a conveyance guide 6, and a registration roller 8. The cassette 1 stores plural sheets of recording medium 2, and the retard roller 5 prevents recording medium 2 from being conveyed by two or more. In an image forming operation, the roller 3 is rotated in synchronism with the image forming operation to separate a single sheet of recording medium 2 from the rest of recording medium 2 in the cassette 1, and conveys it forward. After being sent out of the cassette 1, the recording medium 2 is guided by the guide 6 to the registration roller 8 by way of the roller 7. The registration roller 8 is rotated according to a predetermined sequence, which consists of a period in which the registration roller 8 is not rotated so that the recording medium 2 is kept on standby, and a period in which the recording medium 2 is conveyed toward the intermediary transfer member 9 so that the image and the recording medium 2 are aligned to each other for the transfer process.

Transfer Station

In the transfer station, the pivotable transfer roller 10 is disposed.

The transfer roller 10 consists of a metallic shaft, and an elastic layer wrapped around the metallic shaft. It is movable up and down, and is rotationally driven. While four toner images are formed on the aforementioned intermediary transfer member 9, in other words, while the intermediary transfer member 9 are rotated a predetermined number of times, the transfer roller 10 is kept at the bottom position illustrated in FIG. 1 by a solid line, so that it does not disturb the toner images. Then, after the formation of the four toner images of different color on the intermediary transfer member 9, the transfer roller 10 is moved to the top position illustrated by a fine line in FIG. 1, in synchronism with the timing with which the color toner images are transferred onto the recording medium 2, so that a predetermined amount of pressure is generated to press the recording medium 2 upon the intermediary transfer member 9. Then, bias is applied to the transfer roller 10 to transfer the toner images which were formed on the intermediary transfer member 9, onto the recording medium 2. The intermediary transfer member 9 and transfer roller 10 are individually driven. Therefore, the recording medium 2 pinched by them is conveyed in the illustrated leftward direction at a predetermined velocity, reaching the fixing station 25, as the images are transferred.

Fixing Station

The fixing station 25 is a station in which the toner images, having been transferred onto the recording medium 2, are fixed. Referring to FIG. 1, the fixing station 25 comprises a fixing roller 26 for applying heat to the recording medium 2, and a pressure roller 27 for pressing the recording medium 2 upon the fixing roller 26. Both rollers are hollow and contain heaters 28 and 29, respectively. As heat and pressure are applied to the recording medium 2, which is bearing the toner images by the fixing roller 26 and the pressure roller 27, the toner images are fixed to the recording medium 2.

Cleaning Means Housing

Figure 3:
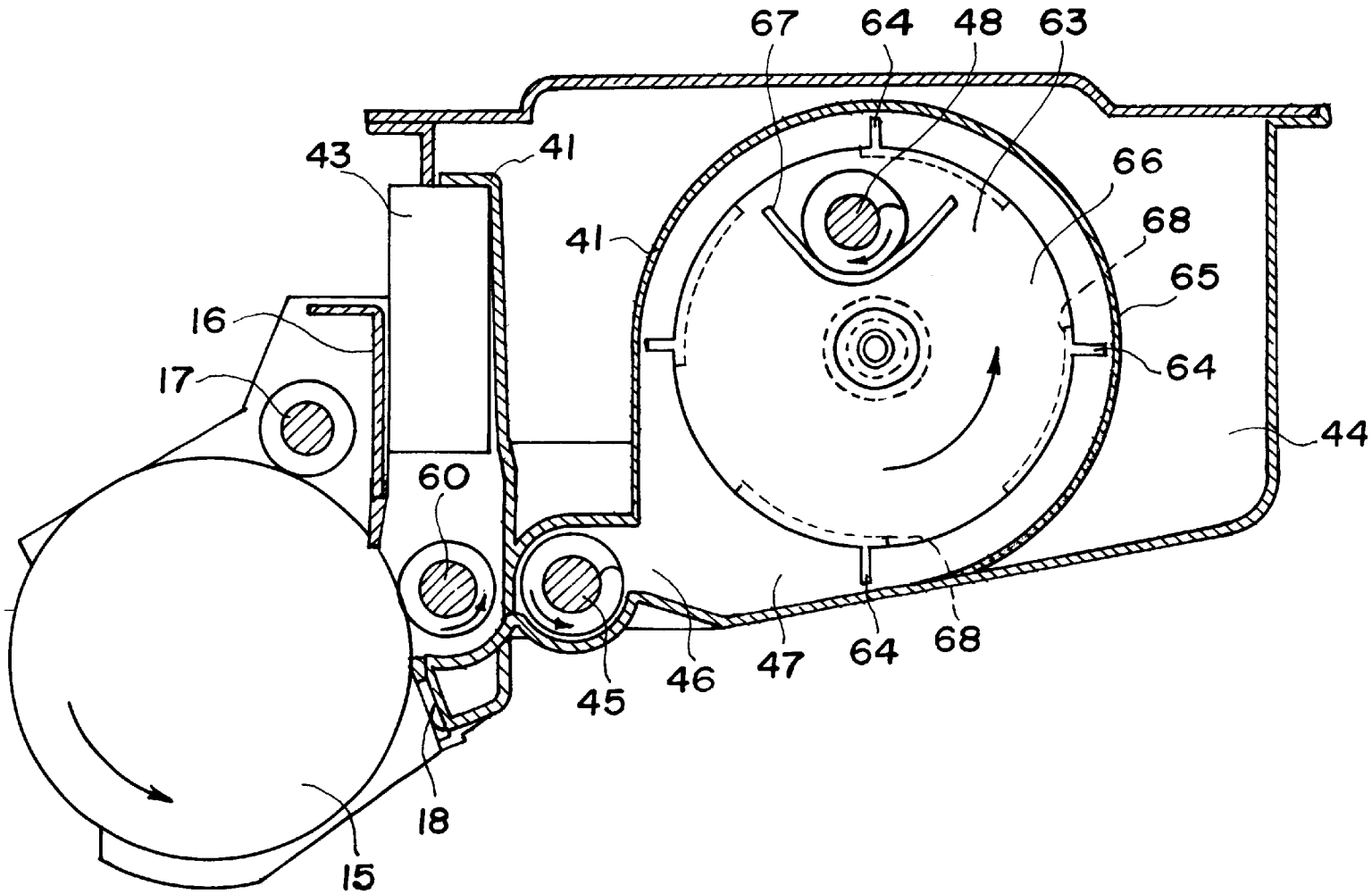
FIG. 3 is a vertical sectional view of a process cartridge in accordance with the present invention.
Figure 4:
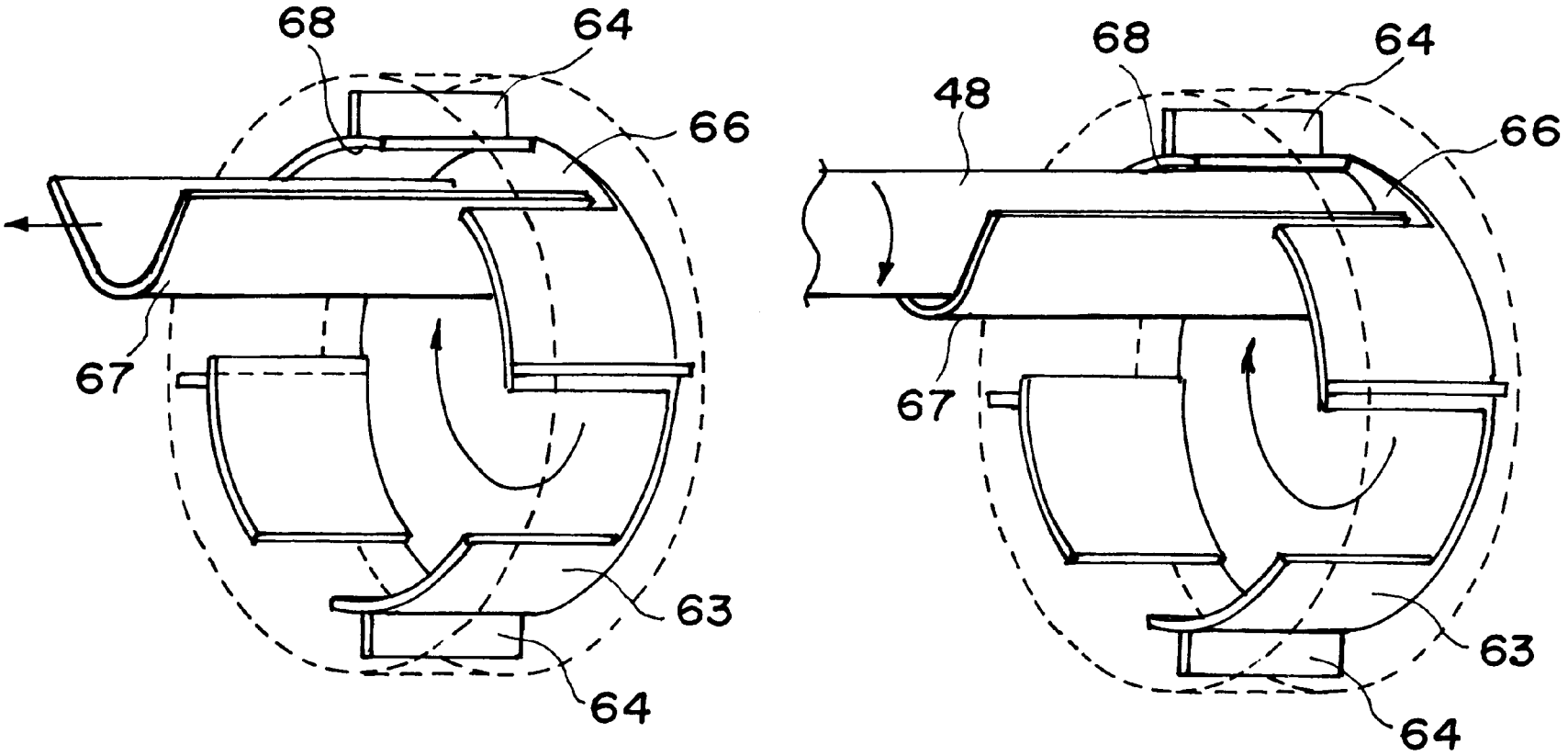
FIG. 4 is a perspective view of a portion of a cleaning means integrated into a process cartridge in accordance with the present invention.
Figure 5:
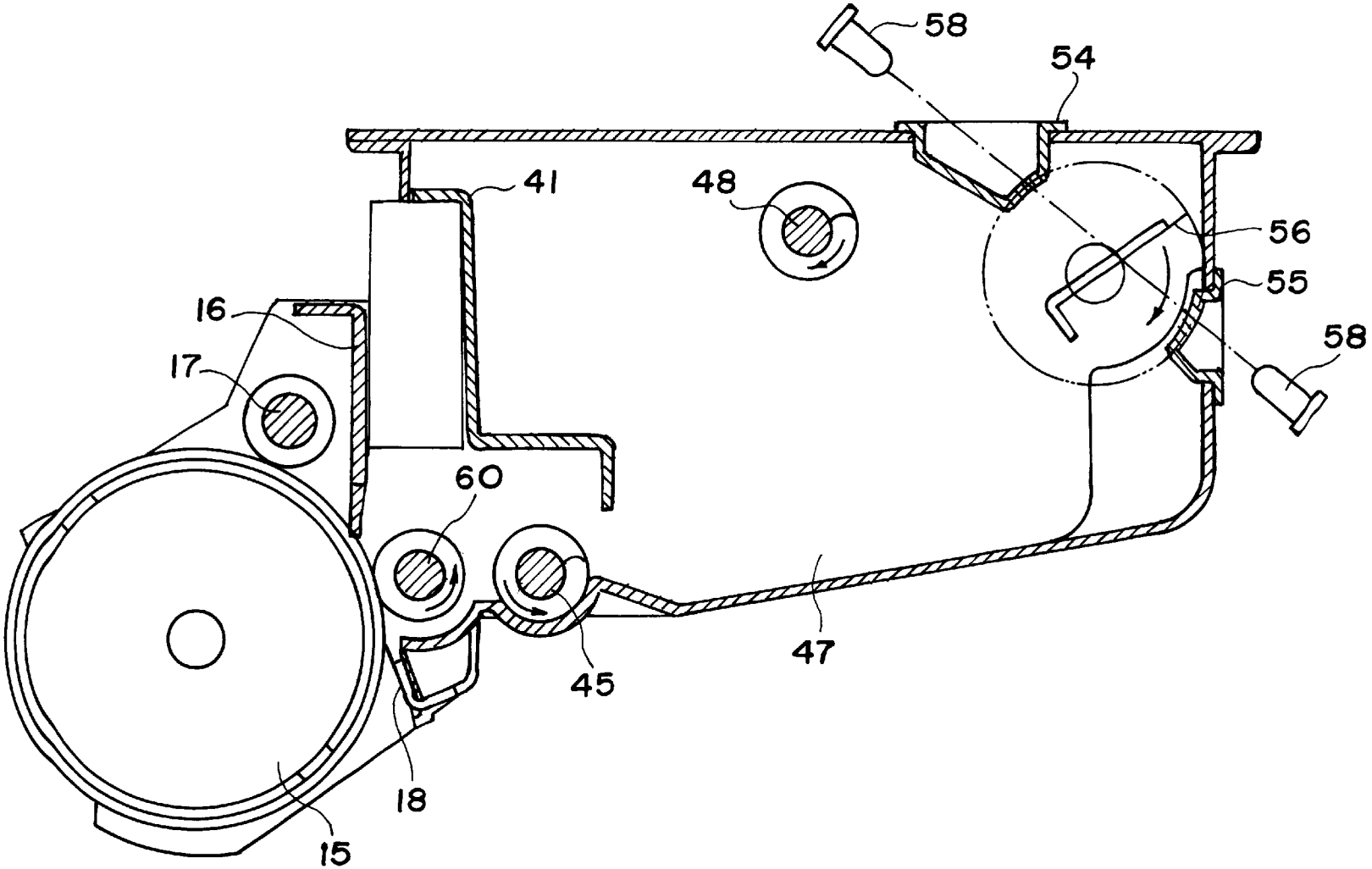
FIG. 5 is a vertical sectional view of another process cartridge in accordance with the present invention.

Next, referring to FIGS. 2 and 3, the cleaning-means housing 14 will be described in detail. In the cleaning-means housing 14, housing partitioning members 41 are disposed. This housing partitioning members 41 partition the internal space of the housing 14 into three chambers: cleaning chamber 43; toner accumulation chamber 44; and intermediary chamber 47. There is disposed a screw 45 adjacent to the partitioning members 41. The toner is moved in the longitudinal direction of the photosensitive drum 15 by the rotation of the screw 45. Further, the partitioning members 41 are provided with an opening 46, which is located adjacent to the downstream end of the screw 45 in terms of the toner conveyance direction.

The photosensitive drum 15 is cleaned by the cleaning blade 16 and the cleaning roller 60. In this embodiment, the cleaning roller 60 is rotated in the direction counter to the rotational direction of the photosensitive drum 15 so that the photosensitive drum 15 is rubbed by the cleaning roller 60. Below the opening 46, a scooping sheet 18 is located in contact with the photosensitive drum 15. The toner remains on the peripheral surface of the photosensitive drum 15 after the transfer enters the cleaning chamber 43 past the scooping sheet 18. Then, this toner is scraped off into the housing 14, first by the cleaning roller 60, and then by the cleaning blade 16. The removed toner is moved rearward of the housing 14 by the cleaning roller 60. If the cleaning blade 16 alone is used to clean the photosensitive drum 15, unlike in this embodiment in which the cleaning roller 60 is used along with the cleaning blade 16 to move rearward the toner, the removed toner is conveyed rearward by a set of feathery members. As the removed toner reaches the developer conveying means constituted of the screw 45, it is conveyed in the longitudinal direction of the photosensitive drum 15 by the rotation of the screw 45. The opening of the aforementioned partitioning member 41 is located outside a range 16*a* in which the photosensitive drum 15 is cleaned.

According to this embodiment, in the third chamber, or the intermediary chamber 47, for toner conveyance, the toner sent in from the cleaning chamber 43 is pushed upward by a paddle wheel 63, which rotates in the intermediary chamber 47, and an intermediary conveyance guide 65. The paddle wheel 63 is a rotational member, and is provided with two or more ribs 64, which are located on the peripheral surface of the wheel 63. The paddle wheel 63 is also provided with openings 66 as well as projections 63, which are located on the upstream side of the ribs 64, one for one, in terms of the rotational direction of the wheel 63. As the toner begins to accumulate in the intermediary chamber 47, the toner is picked up by the ribs 64, being pushed upward along the conveyance guide 65, up to approximately the highest point of the rotational range of the paddle wheel 63 by the projections 68. Then, the toner falls inward of the paddle wheel 63 through the openings 66. Since a toner catcher 67 is provided in the top portion of the internal space of the paddle wheel 63, the toner accumulates in the toner catcher 67 after falling inward of the paddle wheel 63. The toner catcher 67 doubles as a conveyer guide 51, and the toner is accumulated in the toner accumulation chamber 44, starting from the upstream side. With the provision of such a structure, the toner is effectively conveyed upward of the cleaning means housing 14, through the cleaning means housing 14. Thus, compared to a conventional cleaning means housing, the toner is better accumulated in terms of special efficiency. Further, since the intermediary chamber 47 prevents the toner from flowing backward, the toner does not accumulate in the cleaning chamber.

Also in this embodiment, a screw 48 is provided as a toner conveying means in the toner accumulation chamber 44. The direction in which the toner is conveyed by this screw 48 is set to be counter to the toner conveyance direction of the screw 45 in the cleaning chamber 43. Thus, the toner having been conveyed from the cleaning chamber 43 is conveyed into the toner accumulation chamber 44 by the aforementioned conveying means, and gradually accumulates there. Then, as the toner accumulates high enough to reach the screw 48, it is conveyed inward of the accumulation chamber 44 in terms of the longitudinal direction of the process cartridge B. Therefore, even if the photosensitive drum 15 has a long service life, the toner removed from the photosensitive drum 15 can be satisfactorily stored in the toner accumulation chamber 44.

In addition, in the toner accumulation chamber 44, two or more partitioning ribs 53 are provided, which extend perpendicular to the rotational axis of the screw 48, and partition the internal space of the cleaning means housing 14 into smaller sub-chambers. The partitioning ribs 53 may be caused to project from the bottom wall of the cleaning means housing 14, or may be integrally formed with the partitioning members 41. Further, it may be integrally formed with the top cover 50 of the cleaning means housing 14. By partitioning the toner accumulation chamber 44 with the use of the partitioning ribs 53 as described above, the sub-chambers are filled with the toner, starting from the most upstream side of the screw 48; the toner is most effectively accumulated, in terms of spatial efficiency, in the most upstream sub-chamber, and then, after the most upstream sub-chamber is filled up, the toner begins to be accumulated in the second most upstream sub-chamber. In other words, the toner is very effectively accumulated in the terms of the spatial efficiency relative to the overall internal space of the cleaning means housing 14. In addition, the performance of the process cartridge B, with respect to preventing the toner from flowing backward when the process cartridge B is removed by a user from the apparatus main assembly 13, is further improved by the presence of the partitions 53.

Further, in this embodiment, a means for indicating that the cleaning means housing 14 is filled up with the toner is positioned in the most downstream sub-chamber 44E among the sub-chambers created by the partitions 53. This full state detecting means is an optical means. More specifically, the toner accumulation chamber is provided with light transmission windows 54 and 55 which are in the top wall, and the side wall in the rear, respectively (FIG. 2), and the apparatus main assembly is provided with a light emitting portion 58 and a light receiving portion 58. In operation, a beam of light is projected from the light emitting portion 58 into the chamber 44E, and the presence or absence of the toner is determined by whether or not the light beam projected into the chamber 44E is detected by the light receiving portion 58. In this embodiment, this chamber 44E is the last chamber into which the toner is conveyed by the aforementioned toner conveyance means. As the toner accumulates as high as the windows 54 and 55, the inwardly projected light beam is blocked by the toner, being prevented from being detected by the receiving portion 58. As a result, it is determined that the toner accumulation chamber is full. This information is transmitted to the apparatus main assembly 13, and is displayed in the operation panel, or is directly displayed by the computer, to inform the user that the process cartridge B needs to be replaced. At this point in time, the cleaning chamber 43 has not been filled up with the toner, and therefore, cleaning failure does not occur. With the provision of the full state detecting means in the most downstream chamber, it is possible to prevent the cleaning means housing 14 from being overfilled with the toner. Therefore, it is possible to prevent the cleaning failure for which the overfilling of the cleaning apparatus housing with the toner is responsible, and also to prevent the toner from leaking into the apparatus main assembly 13.

According to this embodiment, the windows 54 and 55 are cleaned by a feathery rotational cleaning blade 56. As for the rotational direction of this feathery cleaning blade 56, the feathery blade 56 is rotated in such a direction (direction indicated by an arrow) that the light transmission window 54*a* is first cleaned, and then, the light transmission window 55 is wiped next. Further, backflow prevention ribs 57 are provided on both sides of the light transmission windows, one for one, so that the toner does not flow back onto the windows after it is wiped away by the feathery cleaning blade 56.

Process Cartridge

Next, referring to FIGS. 6, 7, 8, and 9, the process cartridge B will be described.

The process cartridge B in this embodiment integrally comprises the photosensitive drum 15, charge roller 17 as a processing means, and cleaning means, which were aforementioned. It is removably installable in the main assembly of an image forming apparatus.

The photosensitive drum 15 comprises a cylinder portion 15*a* coated with a photosensitive layer, and flange portions 15*b* and 15*c* which are fixed, one for one, to the longitudinal ends of the cylinder portion 15*a*. The flange portion 15*b* is provided with a drum shaft 15*d*, and the flange portion 15*c* is provided with a hole 15*g* through which a drum shaft 15*e* is put.

Figure 9:
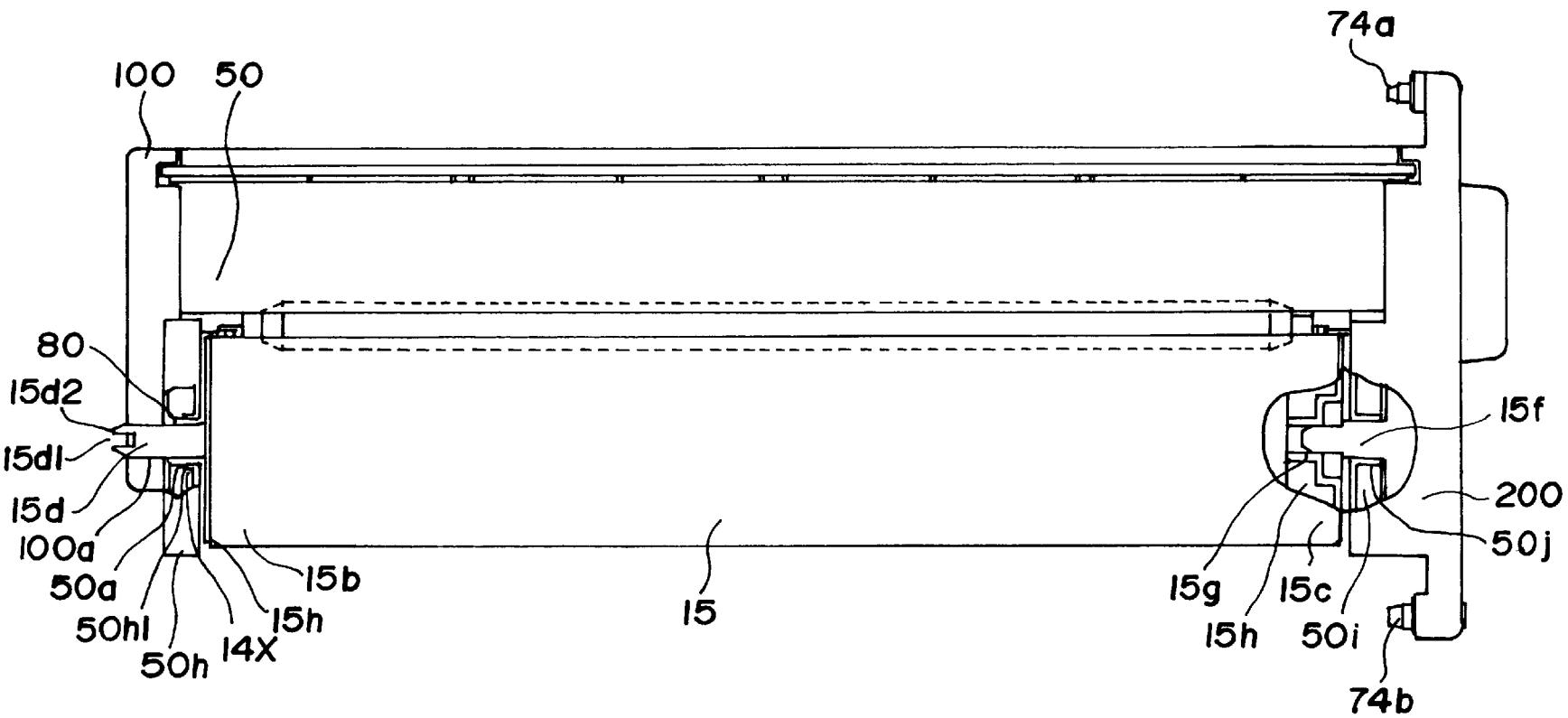
FIG. 9 is a plan view of another process cartridge in accordance with the present invention.

The drum shaft 15*d* extends outward through a hole 100*a* with which a cover 100 is provided. It is rotationally supported by the main frame portion 50 of the cartridge housing; it is supported by a bearing 80 fitted in a hole 14*x* with which the main frame portion 50 is provided (FIG. 9). The axis of the drum shaft 15*d* coincides with the axis of a drum flange 15*h* which is a portion of the photosensitive drum 15 (FIG. 9). Further, the drum shaft 15*d* is provided with a groove 15*d*1, as a drum driving force transmitting portion, located at the tip of the drum shaft 15*d*. As the process cartridge B is installed into the apparatus main assembly, this groove 15*d*1 engages with a coupling member 61 with which the apparatus main assembly is provided, and receives the driving force or rotating the photosensitive drum 15 from the coupling member 61.

In this embodiment, the tip portion 15*d*2 of the drum shaft 15*d* functions as the drum grounding contact point. In other words, the tip portion 15*d*2 is the contact point through which the photosensitive drum 15 is electrically connected to the apparatus main assembly to ground the photosensitive drum 15 as the process cartridge B is installed into the apparatus main assembly.

A reference numeral 40 designates a grounding contact point for the cleaning roller 60. It is the contact point through which cleaning roller 60 is connected to the apparatus main assembly to be grounded as the process cartridge B is installed in the apparatus main assembly.

As for the hole 15*g*, the drum shaft 15*e* with which the side cover 200, located on the side opposite to where the drum shaft 15*d* is located, is provided, is put through the hole 15*g*. This hole 15*g* is located at the center of the drum flange 15*h* which is a portion of the photosensitive drum 15 (FIG. 9).

Also in the drawing, a reference numeral 64 designates a coupling member as the portion for receiving the cleaning-apparatus driving force. As the process cartridge B is installed into the apparatus main assembly, this coupling member 64 engages with the coupling member 80 with which the apparatus main assembly is provided, so that the coupling member 64 receives the force for rotationally driving the aforementioned cleaning means. With the transmission of this driving force, the screw 45, screw 48, cleaning roller 60, and paddle wheel, which are aforementioned, are rotated.

A reference numeral 70 designates a charge-bias contact point, through which the aforementioned bias is applied to the charge roller 17 from the apparatus main assembly when the process cartridge B is in the apparatus main assembly.

A reference numeral 71 designates a connector, which is a member for establishing electrical connection between a memory 72 (for example, RAM, ROM, or the like) with which the apparatus main assembly is provided, and the apparatus main assembly. The memory 72 is a component for storing the data regarding the process cartridge B, for example, the number of the rotations of the photosensitive drum 15, the charging time for charging the photosensitive drum 15 by the charge roller 17, and the like.

A reference numeral character 73 designates a positioning indentation. As the process cartridge B is installed into the apparatus main assembly, this positioning indentation 73 engages with the dowel (unillustrated) with which the apparatus main assembly is provided, to accurately position the process cartridge B.

Reference characters 74*a* and 74*b* designate positioning pins. As the process cartridge B is installed into the apparatus main assembly, these positioning pins 74*a* and 74*b* engage, one for one with the holes (unillustrated) with which the apparatus main assembly is provided, to accurately position the process cartridge B.

A reference numeral 75 designates a handle, which is to be held by a user to carry the process cartridge B. When the process cartridge B is installed into the apparatus main assembly, this handle 75 is retracted into a recess 75*a*.

Figure 6:
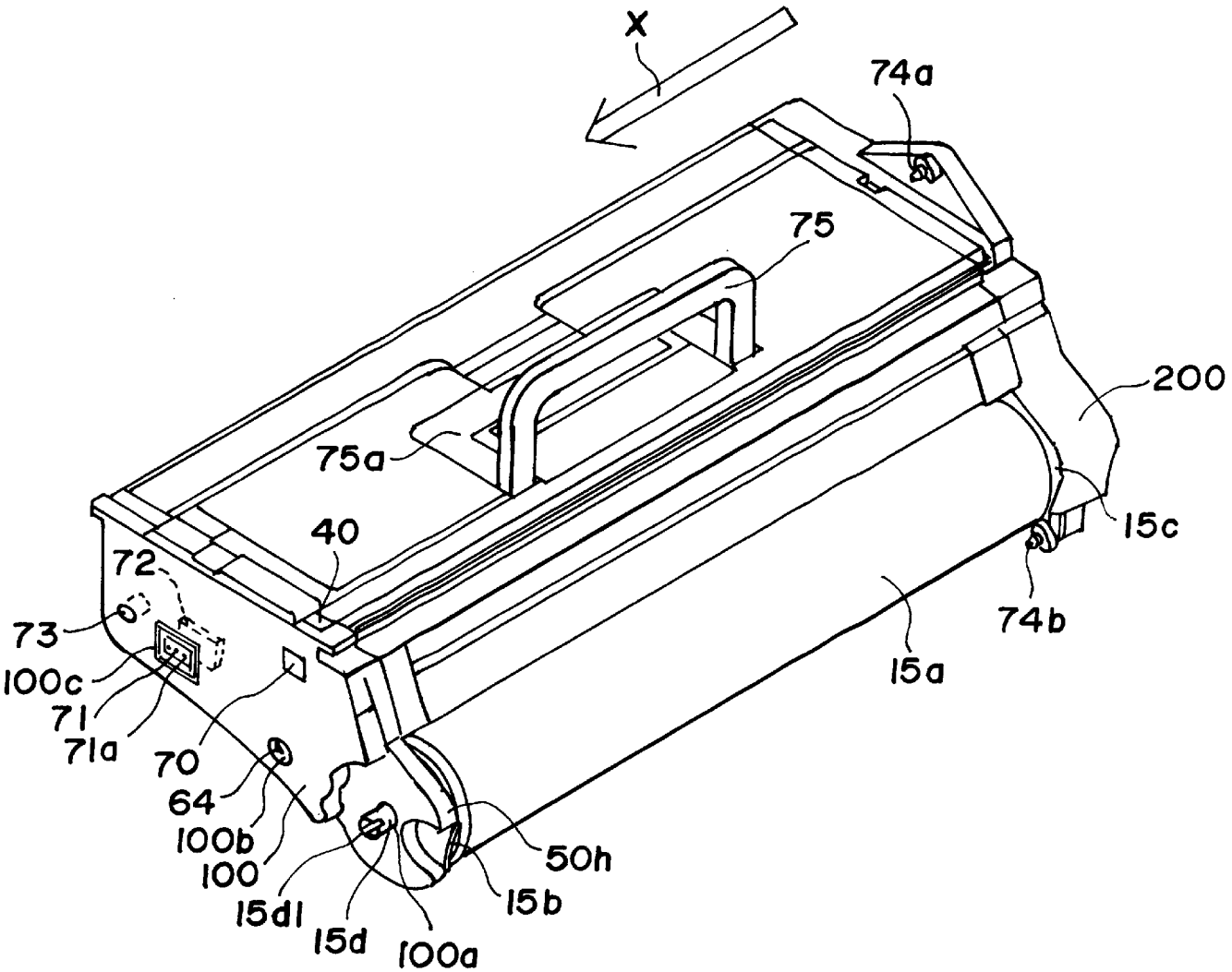
FIG. 6 is an external perspective view of a process cartridge in accordance with the present invention.
Figure 7:
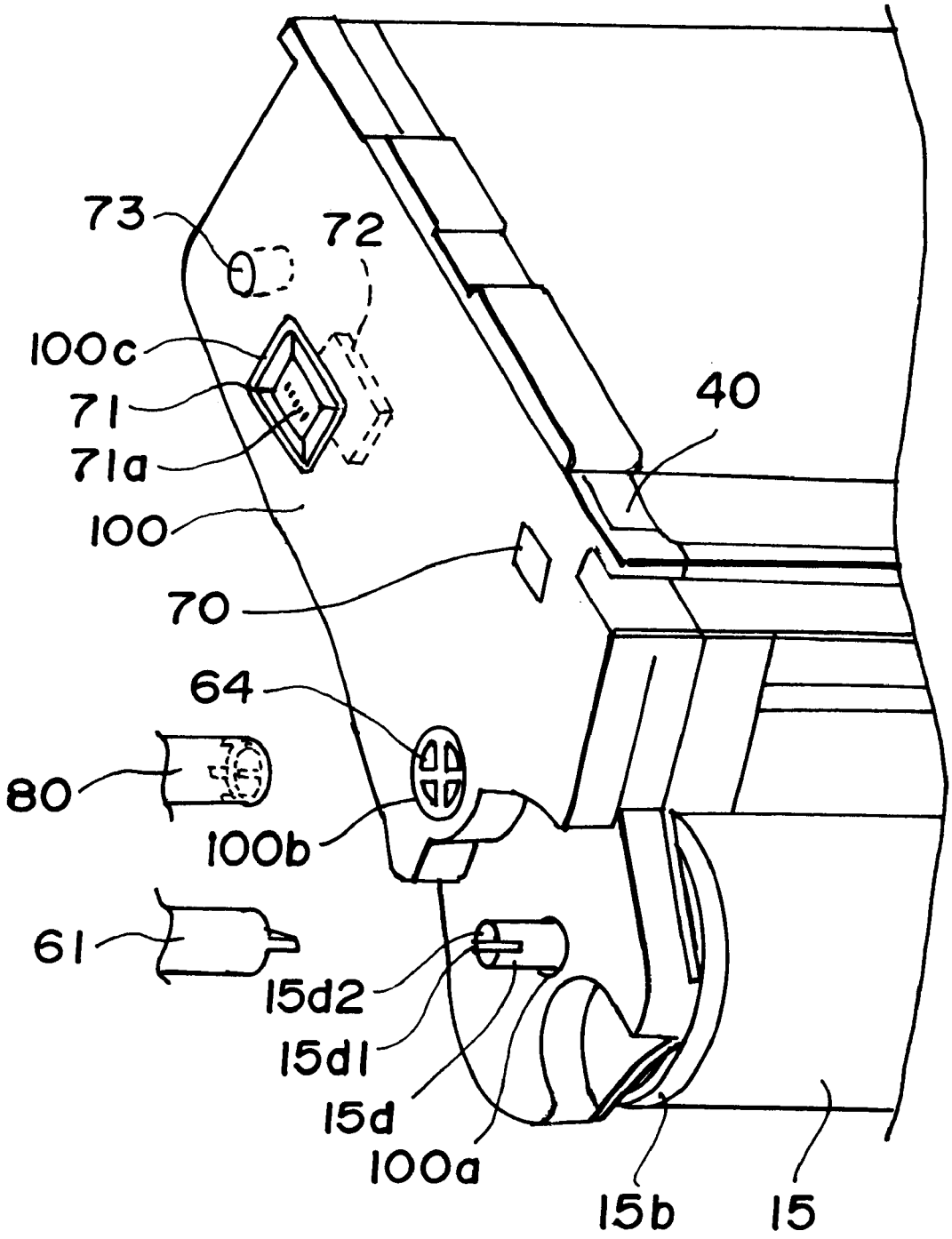
FIG. 7 is an external perspective view of a portion of another process cartridge.
Figure 8:
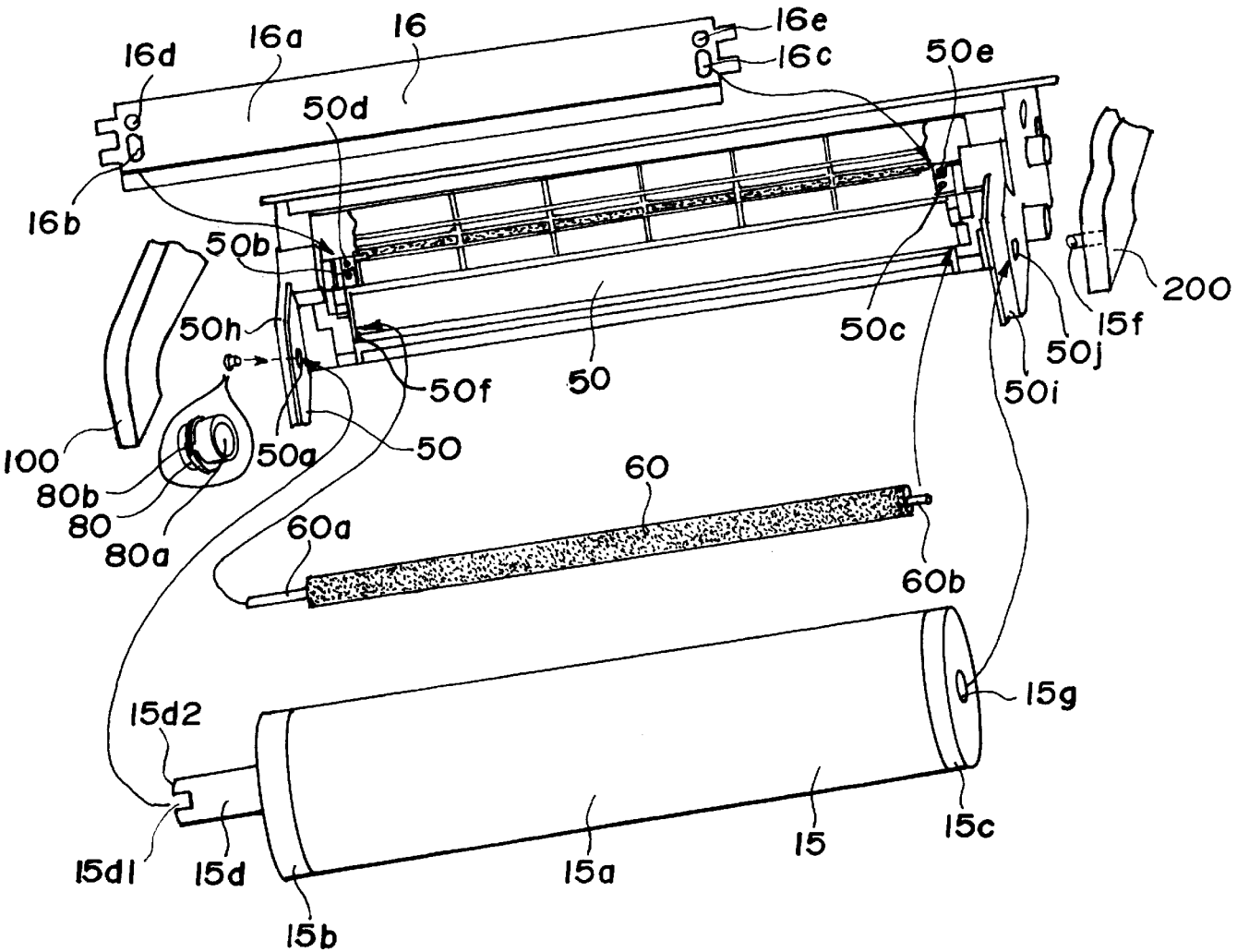
FIG. 8 is a perspective view of a disassembled process cartridge in accordance with the present invention.

The process cartridge B is installed into, or removed from, the apparatus main assembly, in the longitudinal direction of the process cartridge B, (direction indicated by an arrow marked X in FIG. 6).

The aforementioned side cover 100 is provided with a charge bias contact point; the aforementioned charge bias contact 70 is attached to the side cover 100. It is also provided with a recess, that is, the aforementioned positioning indentation. Further, the side cover 100 is provided with the aforementioned hole 100*a*, the aforementioned hole 100*b* through which the cleaning means driving force receiving portion 64 extends outward, and a hole 100*c* through which the connector 71 extends outward. The side cover 100 is removably attached to one of the longitudinal ends of the cleaning means housing 14, a part of the process cartridge frame, with the use of screws.

The description of the process cartridge B given above may be summarized as follows.

The process cartridge B in this embodiment, which is removably installable in the main assembly of the electrophotographic image forming apparatus comprises: the cartridge frame portions (50, 100, and 200); the electrophotographic photosensitive drum (15); the cleaning means as a processing means, which works on the aforementioned electrophotographic photosensitive drum (15); a charging means as another processing means, which also works on the aforementioned electrophotographic photosensitive drum (15); the first drum shaft (15*d*) with which one of the longitudinal ends of the electrophotographic photosensitive drum is provided so that this end of the electrophotographic photosensitive member (15) can be supported by the frame portion (50), more specifically, by the bearing member (80) fitted in the hole (50*a*) with which the frame portion (50) is provided; and the second drum shaft (15*f*), with which the other longitudinal end of the electrophotographic photosensitive drum (15) is provided so that this end of the electrophotographic photosensitive drum (15) can be supported by the frame portion (50), the second drum shaft (15*f*) being provided with the driving force receiving portion (groove 15*d*1) to receive the driving force for rotating the electrophotographic photosensitive member (15) from the apparatus main assembly when the process cartridge B is in the apparatus main assembly, one end of the second drum shaft (15*f*) being fitted in the hole (15*g*) located in the longitudinal end of the electrophotographic photosensitive drum (15) on the side opposite to where the first drum shaft (15*d*) is located, and the other longitudinal end of the second drum shaft (15*f*) being supported by the frame portion (200).

In order to extend the driving force receiving portion (portion with groove 15*d*1) outward through the frame portion (100), the frame portion (100) is provided with the through hole (100*a*) through which the first drum shaft (15*d*) is put.

The frame portion (100) constitutes the side cover that is removably attached to one of the longitudinal ends of the main frame portion (50) as a part of the cartridge frame with the use of screws.

The frame portion (200) that supports the second drum shaft (15*f*) is the side cover that is removably attached to the other longitudinal end of the main frame portion (50).

The driving force receiving portion (groove 15*d*1) is constituted of the groove (15*d*1) located at the tip of the first drum shaft (15*d*). It engages the coupling member (41) with which the apparatus main assembly is provided, as the process cartridge B is installed into the apparatus main assembly.

Process Cartridge Assembly Method

Next, referring to FIGS. 8, 10, 11, 13, and 14, a method for attaching the cleaning blade 16, cleaning roller 60, and photosensitive drum 15 to the main frame portion 50 of the process cartridge B will be described.

First, the method for attaching the cleaning blade 16 will be described.

First, long holes 16*b* and 16*c* located, one for one, in the longitudinal ends of the metallic base plate of the cleaning blade 16*a* are engaged with the dowels 50*b* and 50*c*, respectively, with which the frame portion 50 is provided. Next, the position of the cleaning blade 16 is adjusted. Then, it is fixed to the frame portion 50 by placing screws through holes 16*d* and 16*e* with which the metallic base plate is provided, and screwing them into the screw holes 50*d* and 50*e* with which the frame portion 50 is provided.

Next, the method for attaching the cleaning roller 60 will be described.

The cleaning roller 60 is attached to the cleaning means housing 14 by inserting a shaft 60*a* with which one of the longitudinal ends of the cleaning roller 60 is provided, into a hole 50*f* with which the frame portion 50 is provided, and then, attaching a shaft 60*b* with which the other longitudinal end of the cleaning roller 60 is provided, to the frame portion 50.

The cleaning roller consists of a metallic cylinder, that is, the base member, and a pile of electrically conductive fiber planted on the peripheral surface of the metallic cylinder.

The photosensitive drum 15 is attached to the frame portion 50 in the following manner.

Figure 10:
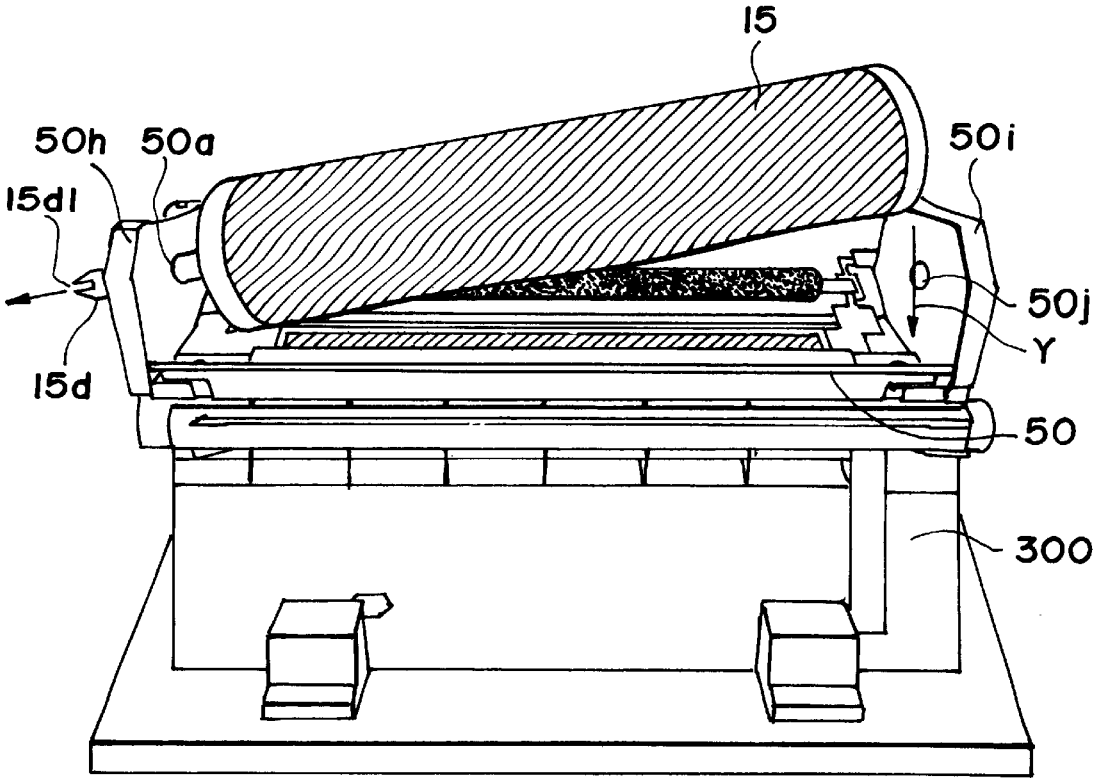
FIG. 10 is a perspective view of a process cartridge in accordance with the present invention, which depicts a method for assembling a process cartridge in accordance with the present invention.
Figure 11:
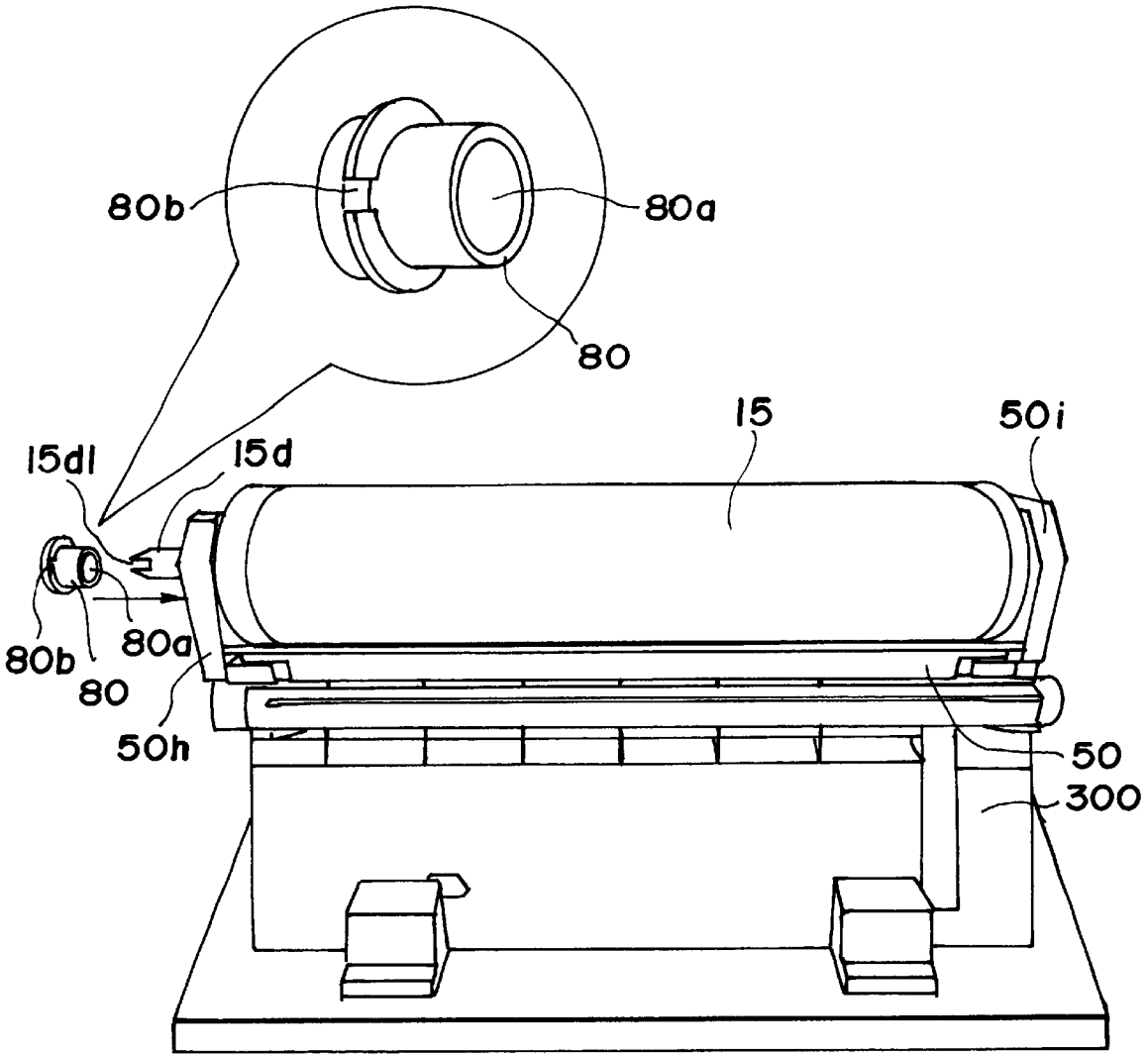
FIG. 11 is a perspective view of another process cartridge in accordance with the present invention, which depicts a method for assembling another process cartridge in accordance with the present invention.

FIGS. 10 and 11 are perspective views of the photosensitive drum 15, and the frame portion 50 which has been set on the assembly form.

First, the drum shaft 15*d* with which one of the longitudinal ends of the electrophotographic photosensitive drum 15 is provided, is inserted into the hole 50*a* with which the projection 50*h* of the frame portion 50 is provided (first insertion step). The projection 50*h* is located at one of the longitudinal ends of the frame portion 50, and projects in the direction perpendicular to the longitudinal direction of the frame portion 50.

Next, the other longitudinal end of the electrophotographic photosensitive drum 15 is pushed (in the direction indicated by an arrow in FIG. 10) into the space between the projection 50*h*, and a projection 50*i* with which the other longitudinal end of the frame portion 50 is provided, in such a manner that the surface of the other longitudinal end of the photosensitive drum 15 aligns with the projection 50*i* (positioning step) (FIG. 10). The projection 50*i* projects also in the direction perpendicular to the longitudinal direction of the frame portion 50. In other words, with the drum shaft 15*d* being held in the hole 50*a* of the frame portion 50, the longitudinal end of the photosensitive drum 15, located on the side opposite to the drum shaft 15*d*, is moved so that the surface of this end of the photosensitive drum 15 squarely faces the projection 50*i* with which this longitudinal end of a frame portion 50 is provided, and which projects in a direction perpendicular to the longitudinal direction of the frame portion 50.

Then, the drum shaft 15*f* with which the cover 200 located on the side opposite to the drum shaft 15*d* is provided, is put through the hole 50*j* with which the aforementioned projection 50*i* of the frame portion 50 is provided, from outward side of the projection 50*i*, and then is inserted into the hole 15*g* with which the longitudinal end of the photosensitive drum 15 located on the side opposite to the drum shaft 15*d* is provided (second insertion step).

Next, the drum shaft 15*d*, which has been put through the hole 50*a* of the frame portion 50 in the first insertion step, is inserted into the hole 80*a* with which the bearing 80 is provided. Then, the bearing 80 is fitted into the hole 50*a* of the frame portion 50 (bearing fitting step) (FIG. 11).

Next, after the drum shaft 15*d* is inserted into the hole 100*a* of the first side cover 100, the first side cover 100 is joined with the frame portion 50 (first side cover joining step).

Next, the second side cover 200 is joined with the frame portion 50 (second side cover joining step).

In the bearing fitting step, the recessed portion 80*b* with which the bearing 80 is provided, is engaged with a projection 50*h*1 with which the projection 50*h* is provided (rotation prevention step).

Figure 14:
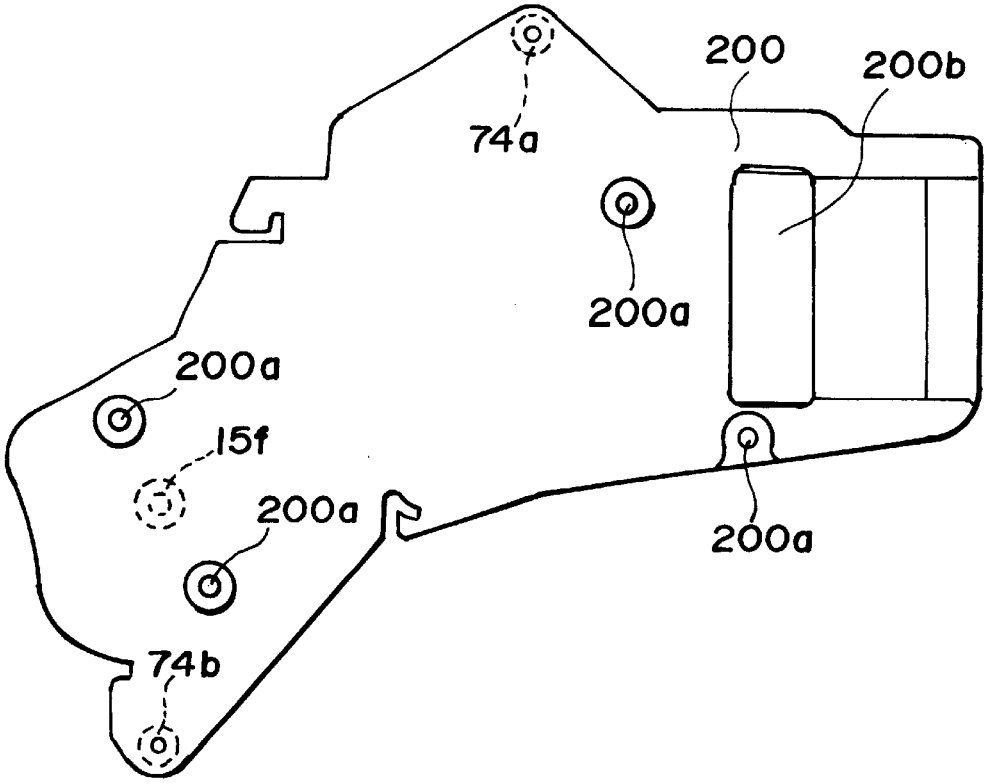
FIG. 14 is a plan view of a cover located at the other end of the process cartridge.

In the aforementioned second side cover joining step, that is, in the process in which the second side cover 200 is joined with the frame portion 50, the second side cover 200 is screwed to projection 50*i* of the frame portion 50 by at least two points (200*a*) symmetrically located about the aforementioned drum shaft 15*f* (FIG. 14). In FIG. 14, a reference character 200*a* designates a screw hole, and a reference character 200*b* designates a handle 200*b*.

Figure 13:
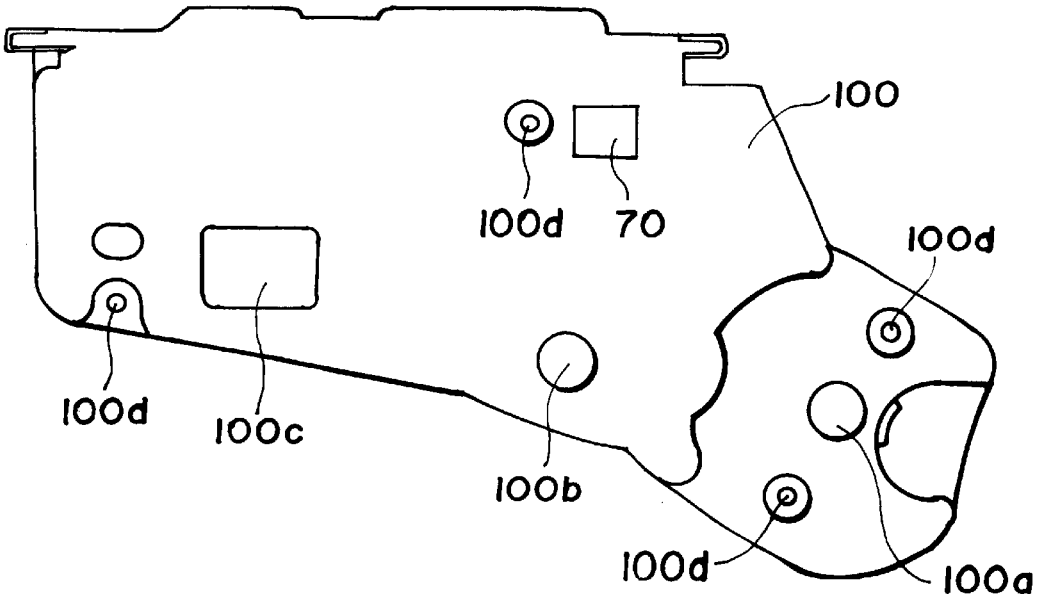
FIG. 13 is a plan view of a cover located at one of the longitudinal ends of a process cartridge.

In the aforementioned first cover joining step, the first side cover 100 is screwed to the frame portion 50 so that the second hole 100*c* with which the first side cover 100 is provided, aligns with the terminal of the connector 70 with which the frame portion 50 is provided, and also, the third hole 100*a* with which the first side cover 100 is provided, aligns with the driving force receiving portion 15*d*1 with which the frame portion 50 is provided (FIG. 13). In FIG. 13, a reference character 100*d* designates a screw hole.

Following the aforementioned drum positioning step, the second insertion step is carried out. It should be noted that the first side cover joining step must be carried out after the completion of the bearing fitting step. However, as far as the second side cover joining step and the bearing fitting step are concerned, either may be carried out in any order. Further, regarding the first side cover joining step and the second side cover joining step, either may be carried out in any order.

As described above, according to this embodiment, the diameter of the hole 50*a* of the frame portion 50*a* is made greater than the external diameter of the drum shaft 15*d*, making it possible to secure a sufficient gap between the surfaces of the frame portion hole 50*a* and the drum shaft 15*d* when the photosensitive drum 15 is positioned to make the surface of the second longitudinal end of the photosensitive drum 15 squarely face the frame portion projection on the second end side. Therefore, the photosensitive drum 15 can be smoothly positioned into the space between the first and second projections of the frame portion. After the photosensitive drum 15 is accurately positioned, the bearing 80 is fitted into the frame portion hole 50*a*, so that the photosensitive drum 15 can be accurately rotated. Further, according to this embodiment, the drum shaft 15*d* to which the driving force from the apparatus main assembly is transmitted is supported by the bearing 80, and therefore, the surface of the frame portion hole 50*a* is prevented from being frictionally worn by the rotation of the drum shaft 15*d*; it is possible to prevent the rotational wobbling of the drum shaft 15*d*. As a result, the driving force transmission accuracy can be maintained.

Recycling of Process Cartridge

Next, a method for recycling the process cartridge B will be briefly described.

The recycling method which will be described below, is a simple method for recycling the process cartridge B. According to this method, the process cartridge B components judged reusable through inspections are recycled.

The normal steps in the process cartridge B recycling process are as follows:

(1) a step for replacing the used photosensitive drum with a new one;

(2) a step for extracting the waste tone within the cleaning means housing 14;

(3) a step for erasing the contents in the memory 72; and (4) a step for replenishing the process cartridge B with a piece of solid lubricant to be coated on the peripheral surface of the photosensitive drum 15 by way of the cleaning roller 60.

It should be noted here, however, that the process-cartridge B recycling process requires other steps besides the above listed basic steps. For example, it requires: inspection; replacement of the components determined unfit for recycling through the inspections; cleaning of the components such as the housing; post-assembly inspections; and the like.

First, the photosensitive drum replacement step (1) will be described. When replacing the photosensitive drum 15, the aforementioned method for attaching a photosensitive drum is used.

The method for replacing a used electrophotographic photosensitive drum with a new one comprises the following steps:

(e) a first side cover removing step for removing the first side cover 100 which had been joined with the first longitudinal end of the frame portion 50, by removing the screws (unillustrated);

(f) a second side cover removing step for removing the second side cover 200 which was joined with the second longitudinal end of the frame portion 50, by removing the screws (unillustrated);

(g) a bearing removing step for removing the bearing 80 from the hole 50*a* of the frame portion 50 on the first longitudinal end side.

(h) a drum removing step for removing the used photosensitive drum 15 from the cleaning means housing 14; more specifically, the step for removing the photosensitive drum 15 from the space between the first and second projections 50*h* and 50*i*, which project from the first and second longitudinal ends of the frame portion 50 of the process cartridge B, respectively, in the direction perpendicular to the longitudinal direction of the frame portion 50;

(i) a first insertion step for inserting the drum shaft 15*d* with which the first longitudinal end of a new electrophotographic photosensitive drum 15 is provided, into the first hole 50*a* of the first projection 50*h;*

(j) a drum positioning step for positioning the new electrophotographic photosensitive drum 15 so that its second longitudinal end aligns with the second projection 50*i;*

(k) a second insertion step for inserting the drum shaft with which the second side cover 200 is provided, into the hole 50*g* with which the second longitudinal end of the new electrophotographic photosensitive drum 15 is provided; more specifically, the drum shaft is first put through the hole 50*j* with which the projection 50*i* on the second longitudinal end side of the frame portion 50 is provided, and then, into the hole 15*g* of the drum, from outward side of the hole 50*j;*

(1) a bearing fitting step for putting the drum shaft 15*d* which has been put through the frame portion hole 50*a* on the first longitudinal end side, through the hole 80*a* of the bearing 80, and then, fitting the bearing 80 into the frame portion hole 50*a* on the first longitudinal end side;

(m) a first cover joining step for joining the first side cover 100 on the first longitudinal end side with the frame portion 50 after inserting the drum shaft 15*d* into the hole 100*a* of the cover 100 on the first longitudinal end side; and (n) Second cover joining step for joining the side cover 200 on the second longitudinal end side to the frame portion 50.

The above described bearing fitting step includes the bearing-rotation prevention step for engaging the indentation 80*b* with which the bearing 80 is provided, with the projection 50*h*1, with which the projection 50*h* on the first longitudinal end side is provided, to prevent the bearing 80 from rotating.

In the second cover joining step for joining the side cover 200 on the second longitudinal end side, with the frame portion 50, the side cover 200 is screwed to the projection 50*i* of frame portion 50 on the second longitudinal end side, by at least two points symmetrically located about the drum shaft.

In the first cover joining step, the side cover 100 on the first longitudinal end side is screwed to the frame portion 50 in such a manner that the second hole 100*c* with which the side cover 100 is provided, aligns with the terminal 71*a* of the connector 71 with which the frame portion 50 is provided, and the third hole 100*a* with which the side cover 100 is provided, aligns with the driving force receiving portion 15*d*1 with which the frame portion 50 is provided.

After the drum positioning step, the second insertion step is carried out.

Next, referring to FIG. 12, Step (2) for extracting the waste toner in the cleaning means housing will be described.

Figure 12:
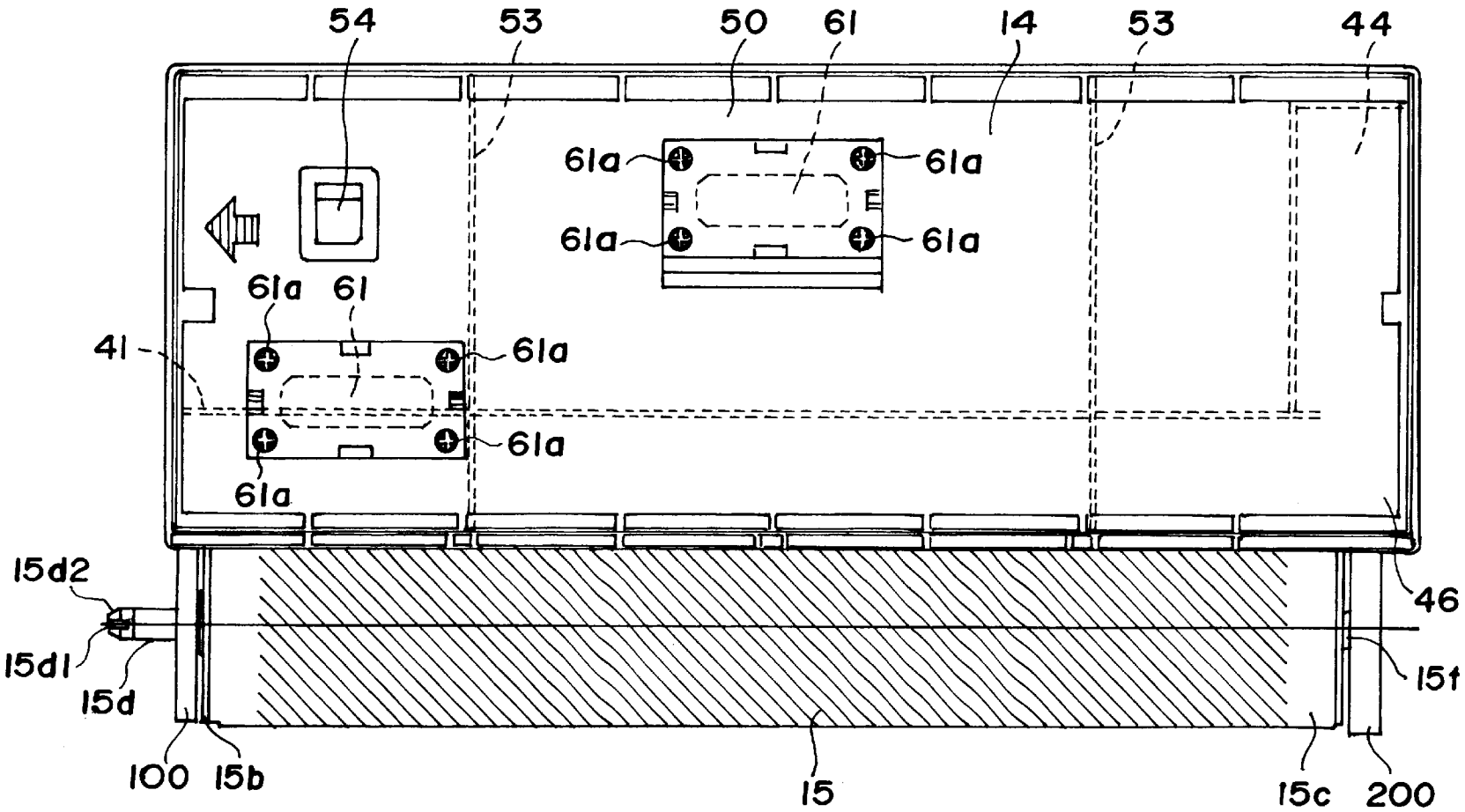
FIG. 12 is a plan view of another process cartridge in accordance with the present invention.

Referring to FIG. 12, at least one toner extraction hole 60 is made through the top wall of the toner accumulation chamber partitioned by two or more partitions 53. In the case of this embodiment, two toner extraction holes 60*a* and 60*b* are made through the top wall of the cleaning means housing 14.

The term "top wall" here, refers to, the wall which comes to the top side as the process cartridge B is installed into the apparatus main assembly. The reason for making holes through the top wall is to eliminate the possibility that the toner might leak through the hole 60*a* and 60*b* after a recycled process cartridge B is installed into the apparatus main assembly. The holes 60*a* and 60*b* are made with the use of a laser cutter, a drill, or the like, and sealed with a molded caps 61 provided with a seal formed of MOLT PLANE or similar elastic material. These caps are fixed to the top wall of the cleaning means housing with the use of small screws 61*a*. However, the cap 61 may be a flexible one which is molded of elastic material such as polyethylene or rubber, and can be fitted without the need for screws. Further, these holes may be covered with adhesive tape or the like.

In the waste toner extraction step in this embodiment, the waste toner is extracted from the toner extraction holes 60*a* and 60*b* by a toner sucking apparatus, for example, a vacuum cleaner, to completely remove the waste toner in the cleaning means housing 14 so that the waste toner, which will be created in future image forming operations, can be stored in the housing 14. Thereafter, the holes 60*a* and 60*b* are sealed by the aforementioned sealing method. Making two toner extraction holes makes it possible to use one hole as an extraction hole, and the other as an air inlet. With this arrangement, the air within the cleaning means housing 14 is undisturbedly circulated, and therefore, the waste toner is prevented from being scattered.

In this embodiment, two waste toner extraction holes are made through the top wall of the partitioned chamber, at two different locations, one for one. However, the number of the waste toner extraction holes does not need to be limited to two; two or more waste toner extraction holes may be made, one for each sub-chamber through the top wall. Also, a toner extraction hole may be made across the partition between the two adjacent sub-chambers. It must be assured that the waste toner in the sub-chamber in which the full state detection mechanism never fails to be extracted, to prevent the toner accumulation chamber from being indicated to be full immediately after a recycled process cartridge is installed in the apparatus main assembly.

In Step (3), the contents in the memory are erased by a known method, to make it possible for new information to be stored. More specifically, after the memory 71 is placed within the process cartridge B, the memory 71 is initialized across the entire addresses. The memory 71 may be cleaned and initialized after it is removed from the process cartridge B.

Next, Step (4) for replenishment of lubricant will be described.

This lubricant is constituted of a piece of solid lubricant, and is attached to a portion of the cleaning means housing which houses the cleaning roller 60, so that it extends in the longitudinal direction of the cleaning roller 60. Normally, the lubricant in a process cartridge is almost entirely consumed by the time a process cartridge is recycled, and therefore, a fresh piece of solid lubricant is attached as described above. The solid lubricant is rubbed by the tip of the blush portion of the cleaning roller, adhering to the tip, as the cleaning roller 60 is rotated. Then, the lubricant on the brush is coated on the peripheral surface of the photosensitive drum 15.

A process cartridge is recycled through the above described steps.

The main portion 50 of the process cartridge frame, projection 50*h* on the first longitudinal end side of the process cartridge B, side cover 100 on the first longitudinal end, and side cover 200 on the second longitudinal end, are all parts of the process cartridge frame. The process cartridge frame is formed of plastic material, for example, polystyrene, ABS (copolymer composed of acrylonitrile, butadiene, and styrene), polycarbonate, polyethylene, or polypropylene. The bearing 80 is formed of plastic material, for example, polyoxymethylene (POM).

As described above, according to the present invention, it is possible to improve the efficiency with which an electrophotographic photosensitive drum is attached to the frame of a process cartridge, and the efficiency with which the electrophotographic photosensitive drum is replaced.

Further, it is possible to maintain the rotational accuracy of an electrophotographic photosensitive drum.

In addition, it is possible to minimize the reduction in the strength of the process cartridge frame.

Also according to the present invention, a sufficient gap is secured between the internal surface of the hole of the cartridge frame and the peripheral surface of the drum shaft, on the first longitudinal end side of an electrophotographic photosensitive drum, prior to the fitting of a bearing into the hole. Therefore, it is possible to improve the efficiency with which the second longitudinal end of the drum is moved to the point at which it aligns with the projection of the cartridge frame on the second longitudinal end side, after the drum shaft with which the first longitudinal end of the drum is provided, is inserted into the hole of the frame on the first longitudinal end.

While the invention has been described with reference to the structures disclosed herein, it is not confined to the details set forth, and this application is intended to cover such modifications or changes as may come within the purposes of the improvements or the scope of the following claims.

What is claimed is:

1. An electrophotographic photosensitive drum mounting method for mounting an electrophoto graphic photosensitive drum to a frame of a process cartridge detachably mountable to a main assembly of an electrophotographic image forming apparatus, said method comprising:

(a) a first inserting step of inserting a first drum shaft provided at one end of said electrophotographic photosensitive drum into a first frame hole provided in a first projected portion which is projected in a direction crossing with a longitudinal direction of a frame of said process cartridge at one longitudinal end of the frame, said first drum shaft having a driving force receiving portion for receiving, from the main assembly, a driving force for rotating said electrophotographic photosensitive drum;

(b) a facing step of facing, while said first drum shaft is inserted into the first frame hole, the other end of said electrophotographic photosensitive drum to a second projected portion projected from said frame in a direction crossing with the longitudinal direction of said frame at the other longitudinal end of the frame, by moving the other end of said electrophotographic photosensitive drum;

(c) a second inserting step of inserting a second drum shaft provided on a second cover at the other end into a second frame hole provided in a projected portion at the other end of said frame and then into a drum hole formed at the other end of said electrophotographic photosensitive drum, from an outside of the second frame hole;

(d) a bearing member engaging step of fitting a bearing hole of a bearing member around the first drum shaft, and engaging the bearing member with the first frame hole;

(e) a first cover coupling process of fitting a first hole formed in a first cover provided at one end around said first drum shaft, and then connecting the first cover to said frame; and (f) a second cover coupling process of connecting said second cover to said frame.

2. A method according to claim 1, wherein said bearing member engaging step includes a rotation stopping step of engaging a recess of said bearing member with a projection provided on the first projected portion.

3. A method according to claim 1 or 2, wherein in connecting said second cover to said frame in said second cover coupling process, at least two portions opposed from each other with said second drum shaft therebetween are screwed to said second projected portion.

4. A method according to claim 1 or 2, wherein said first cover coupling process includes a step of screwing said first cover to said frame such that a second hole formed in said first cover faces an electric contact of a connector provided on said frame and such that a third hole formed in said first cover faced a cleaning force receiving portion provided in said frame.

5. A method according to claim 1 or 2, wherein said first inserting step, said facing step and then said second inserting step are carried out in this order.

6. A method of exchanging an electrophotographic photosensitive drum in a process cartridge detachably mountable to a main assembly of an electrophotographic image forming apparatus, said method comprising:

(a) a first removing step of removing a first cover at one longitudinal end of a frame by unscrewing;

(b) a second removing step of removing a second cover at the other longitudinal end of the frame by unscrewing;

(c) a bearing member removing step of removing a bearing member engaged with a first frame hole at one end;

(d) removing said electrophotographic photosensitive drum from between a first projected portion projected in a direction crossing with a longitudinal direction of the frame at one longitudinal end of the frame and a second projected portion projected in the crossing direction at the other longitudinal end of said frame;

(e) a first inserting step of inserting a first drum shaft provided at one end of a new electrophotographic photosensitive drum into a first frame hole provided in the first projected portion, said first drum shaft having a driving force receiving portion for receiving, from the main assembly, a driving force for rotating said electrophotographic photosensitive drum;

(f) a facing step of facing, while said first drum shaft is inserted into the first frame hole, the other end of said new electrophotographic photosensitive drum to the second projected portion by moving the other end of said electrophotographic photosensitive drum;

(g) a second inserting step of inserting a second drum shaft provided on the second cover into a second frame hole provided in the second projected portion and then into a drum hole formed at the other end of said new electrophotographic photosensitive drum, from an outside of the second frame hole;

(h) a bearing member engaging step of fitting a bearing hole of a bearing member around the first drum shaft, and engaging the bearing member with the first frame hole;

(i) a first cover coupling process of fitting a first hole formed in the first cover around said first drum shaft, and then connecting the first cover to said frame; and (j) a second cover coupling process of connecting said second cover to said frame.

7. A method according to claim 6, wherein said bearing member engaging step includes a rotation stopping step of engaging a recess of said bearing member with a projection provided on the first projected portion provided at the one end portion.

8. A method according to claim 6 or 7, wherein in connecting said second cover to said frame in said second cover coupling process, at least two portions opposed from each other with said second drum shaft therebetween are screwed to said second projected portion.

9. A method according to claim 6 or 7, wherein said first cover coupling process includes a step of screwing said first cover to said frame such that a second hole formed in said first cover faces an electric contact of a connector provided on said frame and such that a third hole formed in said first cover faces a cleaning force receiving portion provided in said frame.

10. A method according to claim 6 or 7, wherein said first inserting step, said facing step and then said second inserting step are carried out in this order.

11. A process cartridge detachably mountable to a main assembly of an electrophotographic image forming apparatus, said process cartridge comprising:

a frame;

an electrophotographic photosensitive drum;

process means actable on said electrophotographic photosensitive drum;

a first drum shaft provided at one longitudinal end of said electrophotographic photosensitive drum and supported on said frame through a bearing member which is engaged with a first hole formed in said frame to support said electrophotographic photosensitive drum at its one longitudinal end;

a driving force receiving portion, provided on a first drum shaft, for receiving a driving force for rotating said electrophotographic photosensitive drum from a main assembly of said apparatus when said process cartridge is mounted to the main assembly;

a second drum shaft for supporting the other end portion of said electrophotographic photosensitive drum on said frame, said second drum shaft having one end inserted into a hole formed at the other longitudinal end of said electrophotographic photosensitive drum and the other end supported on said frame by engagement of said second drum shaft with a second hole of said frame.

12. A process cartridge according to claim 11, wherein said first drum shaft penetrates a hole formed in said frame to project the driving force receiving portion beyond said frame.

13. A process cartridge according to claim 11 or 12, wherein said frame comprises a cover demountably screwed to a main body of said frame at one end.

14. A process cartridge according to claim 11 or 12, wherein the frame supporting the second drum shaft comprises a cover demountably screwed to a main body of said frame at the other end.

15. A process cartridge according to claim 11 or 12, wherein said driving force receiving portion is in the form of a groove formed at an end of said first drum shaft, and wherein when said process cartridge is mounted to the main assembly of the apparatus, the groove is engaged with a coupling member provided in the main assembly of the apparatus.

16. A process cartridge according to 11 or 12, wherein said process means includes at least one of charging means, developing means and cleaning means.

* * * * *

UNITED STATES PATENT AND TRADEMARK OFFICE

CERTIFICATE OF CORRECTION

PATENT NO. : 6,266,503 B1 
DATED : July 24, 2001
INVENTOR(S) : Kazunari Murayama et al.

It is certified that error appears in the above-identified patent and that said Letters Patent is hereby corrected as shown below:

Title page,
Item [56], References Cited, OTHER PUBLICATIONS,
"Oct.8," should read -- Oct. 8, --.
Item [57], ABSTRACT,
Line 11, "frame of;" should read -- frame; --.
Line 27, "first" (1st occurrence) should read -- a first --.

Column 3,
Line 33, "means" should be deleted.
Line 35, "means" should be deleted.
Line 40, "means" should be -- refer to --.
Line 47, "Electro-photographic" should read -- Electrophotographic --.
Line 57, "photo-sensitive" should read -- photosensitive --.
Line 62, "character" should be deleted.

Column 5,
Line 38, "the state" should read -- the state of --.
Line 63, "image" should read -- images --.

Column 7,
Line 25, "This" should read -- These --.

Column 8,
Line 63, "full state" should read -- full-state --.

Column 9,
Line 66, "or" should read -- for --.

Column 10,
Line 43, "character" should be deleted.
Line 61, "B," should read -- B --.

Column 14,
Line 26, "side." should read -- side; --.
Line 65, "Second" should read -- a second --.

UNITED STATES PATENT AND TRADEMARK OFFICE

CERTIFICATE OF CORRECTION

PATENT NO. : 6,266,503 B1 
DATED : July 24, 2001
INVENTOR(S) : Kazunari Murayama et al.

It is certified that error appears in the above-identified patent and that said Letters Patent is hereby corrected as shown below:

Column 15,
Line 38, “with a” should read -- with --.

Column 16,
Line 67, “electrophoto graphic” should read -- electrophotographic --.

Column 17,
Line 56, “faced” should read -- faces --.

Column 18,
Line 10, “the frame” should read -- a frame of said process cartridge --.

Column 20,
Line 19, “to 11” should read -- to claim 11 --.

Signed and Sealed this

Twenty-sixth Day of November, 2002

*Attest:*

*Attesting Officer*

JAMES E. ROGAN
*Director of the United States Patent and Trademark Office*